United States Patent [19]

Krapf et al.

[11] Patent Number: 4,938,367

[45] Date of Patent: Jul. 3, 1990

[54] WELDMENT-FREE DOCUMENT HOLDER

[75] Inventors: Wallace A. Krapf, Macedon; Robert J. Blood, Holcomb; Daniel W. Rossborough, Conesus, all of N.Y.

[73] Assignee: Krapf Business Systems, Inc., Macedon, N.Y.

[21] Appl. No.: 350,759

[22] Filed: May 12, 1989

[51] Int. Cl.[5] ..... A47F 7/00

[52] U.S. Cl. ..... 211/55; 211/128

[58] Field of Search ..... 211/55, 128; 206/555

[56] References Cited

U.S. PATENT DOCUMENTS

| | | | |
|---|---|---|---|
| 700,465 | 5/1902 | Willy | 211/55 X |
| 1,252,092 | 1/1918 | Currier | 206/555 X |
| 1,458,953 | 6/1923 | Robeson | 206/555 X |
| 1,658,394 | 2/1928 | Rand | 211/55 X |
| 1,858,068 | 5/1932 | Watkins et al. | 211/55 X |
| 3,167,873 | 2/1965 | Toms | 211/55 X |
| 3,515,283 | 6/1970 | Poteat | 211/55 |

*Primary Examiner*—Alvin C. Chin-Shue
*Assistant Examiner*—Sarah A. Lechok
*Attorney, Agent, or Firm*—Shlesinger, Fitzsimmons & Shlesinger

[57] ABSTRACT

The holder includes a sheet metal housing having a back wall, parallel side walls, and a horizontal bottom wall removably secured to and closing the lower end of the housing. A plurality of spaced partitions are removably and slidably supported in the housing in parallel planes extending normal to the side walls, and diagonally of the back wall. These partitions define therebetween a plurality of document holding spaces that are inclined to the vertical, and which are closed at their lower ends, and open at their upper ends on a large opening formed in the front of the housing. Flange sections on the upper edges of the housing end walls releasably overlie portions of the upper edge of the uppermost partition to prevent its removal, and thus the partitions located therebeneath.

12 Claims, 2 Drawing Sheets

FIG. 3
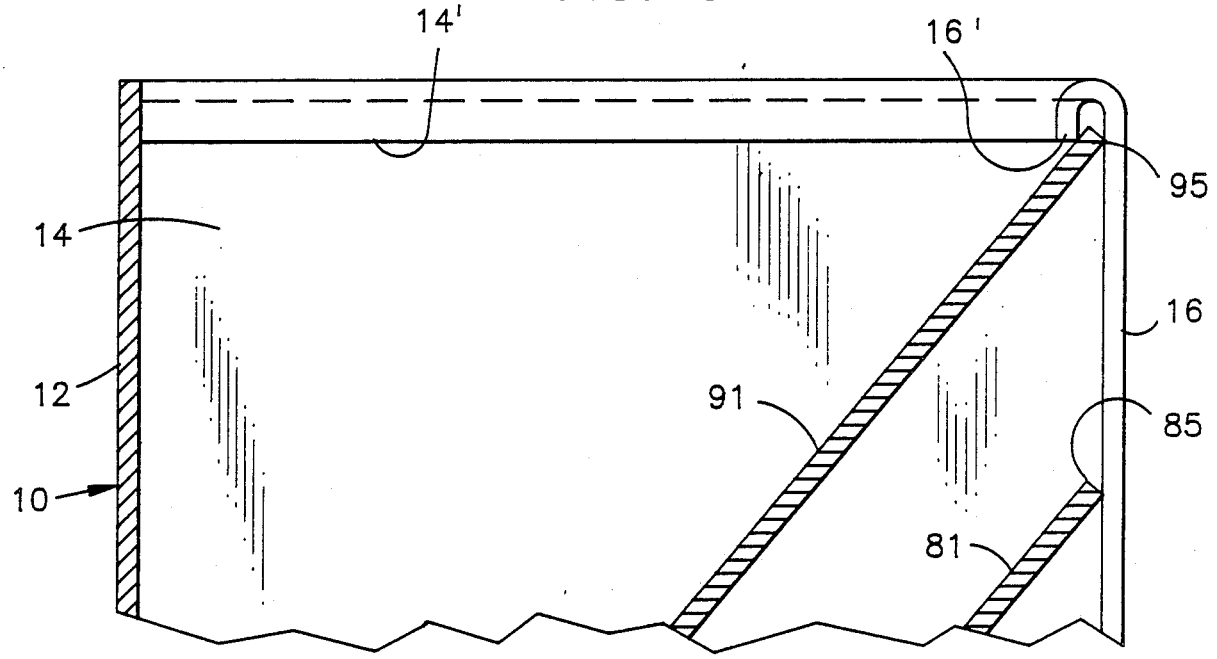
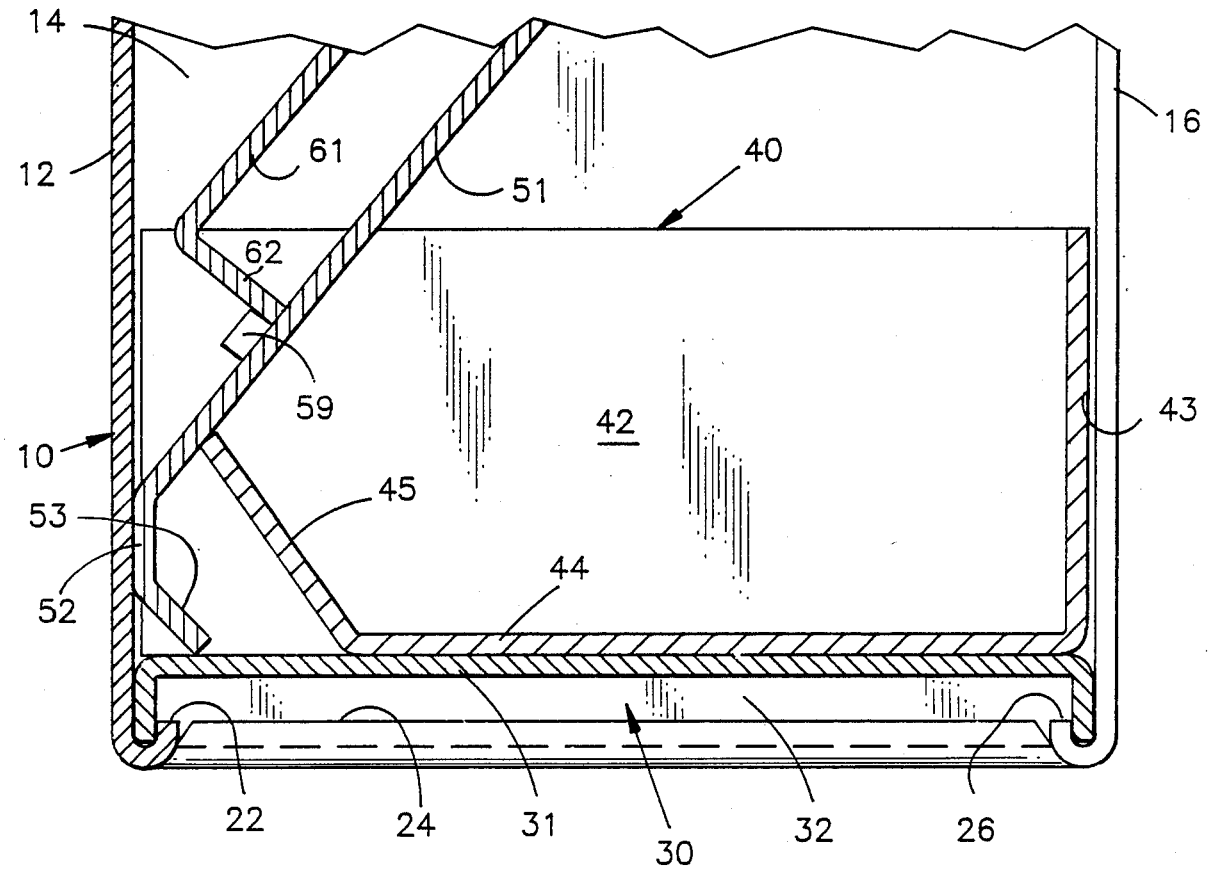
FIG. 4

WELDMENT-FREE DOCUMENT HOLDER

BACKGROUND OF THE INVENTION

This invention relates to document holders made of sheet metal and the like, and more particularly to document holders that are assembled from precut pieces of sheet metal without requiring the weldment of any of the parts.

It has been customary in the past to make upright or free-standing document holders that are generally rectangular in configuration, and which contain a plurality of inclined partitions or dividers that separate the holder into a plurality of adjacent, upwardly-opening bins or recesses in which documents can be stored. A major disadvantage of prior such devices, however, has been the need for mechanically securing together the various parts making up the holder or document storage device. Typically, adjacent or interconnected parts have been spot welded or otherwise physically secured to each other to fix the various components of the device one to the other.

It is an object of this invention, however, to provide an improved document storage device of the type described which is completely weldment-free, or in other words which does not require any means for permanently fixing the various parts of the device one to the other.

Another object of this invention is to provide an improved document holding or storage device which is assembled from precut parts, which are rather simple to assemble into the completed device, and which can be removed and replaced, if necessary.

Other objects of the invention will be apparent hereinafter from the specification and from the recital of the appended claims, particularly when read in conjunction with the accompanying drawings.

SUMMARY OF THE INVENTION

The device is produced from a series of specially shaped pieces of sheet metal, which are releasably secured to each other by interlocking surfaces formed on confronting edges thereof. It comprises a first sheet metal panel bent into a generally rectangular configuration, with its lower edges rolled or bent upwardly and inwardly to support thereon a rectangular cap that closes the lower end of the frame. A series of flat dividers or partitions are mounted in the frame to lie in spaced, parallel, diagonal planes, and to form between adjacent dividers rectangular document holding spaces which open on the front of the frame, and which are closed at their lower ends.

THE DRAWINGS

FIG. 3 is an enlarged, fragmentary sectional view taken generally along the line 3—3 in FIG. 2 looking in the direction of the arrows; and FIG. 4 is an enlarged, fragmentary sectional view taken generally along the line 4—4 in FIG. 2 looking in the direction of the arrows.

DETAILED DESCRIPTION OF THE PREFERRED EMBODIMENTS

Figure 1:
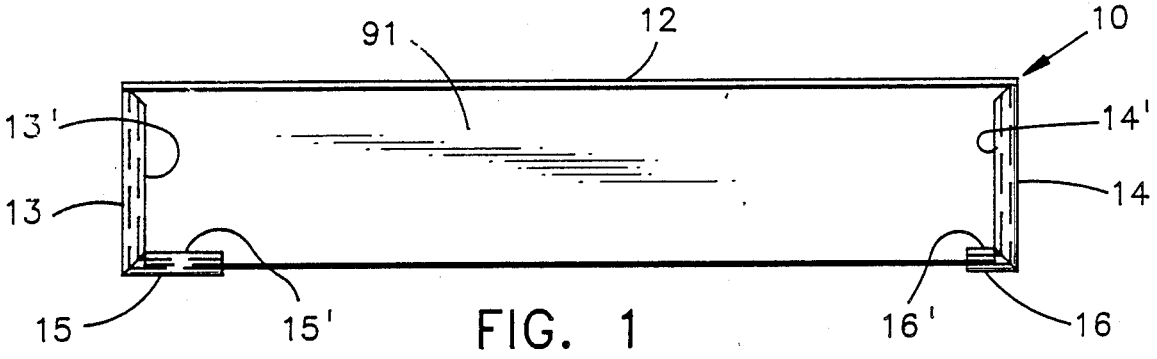
FIG. 1 is a plan view of a document storage device made according to one embodiment of this invention.

Referring now to the drawings by numerals of reference, 10 denotes generally the frame or housing of a document storage device, which in the embodiment illustrated is made from several pieces of sheet metal that are stamped, bent and/or cut into various configurations. The frame 10 is made from a sheet metal blank, and comprises a plane, flat, generally rectangularly shaped back wall 12, a pair of spaced, parallel end walls 13 and 14, which are bent forwardly and equidistantly from the back wall at right angles thereto, and a pair of spaced, coplanar, front wall sections 15 and 16, which are bent at right angles inwardly toward each other from the end walls 13 and 14, respectively. Except for spaced sections 15 and 16 the device does not have a front wall.

The frame 10 is adapted to have a number of sheet metal elements removably mounted therein. For this purpose a marginal portion of the rear or back wall 12 adjacent its lower edge is bent or rolled inwardly and upwardly as at 22 (FIG. 4). Likewise, marginal portions of the remaining wall sections 13, 14, 15 and 16 of frame 10 are bent or rolled upwardly and inwardly adjacent their lower edges as at 23 (FIG. 2), 24 (FIG. 4), 25 (FIG. 2) and 26 (FIG. 4), respectively. Also, adjacent their upper edges marginal portions of the wall sections 13, 14, 15 and 16 are bent or rolled inwardly and downwardly as at 13', 14', 15' and 16', respectively. Frame 10 is closed at its upper end by an inverted, generally rectangularly shaped cap 30 (FIGS. 2 and 4) having a plane, flat upper wall 31, and an integral, rectangularly shaped, downwardly depending skirt portion 32, the lower edges of which seat, as shown in FIG. 4, in a rectangular recess or trough formed inside the lower end of the frame 10 by its rolled edges 22, 23, 24, 25 and 26.

Removably mounted in the frame 10 upon the upper surface of the cap 30 is a generally U-shaped, sheet metal member 40 having spaced, parallel side walls 41 and 42 (FIGS. 2 and 4), which at one end (the right end in FIG. 4) are interconnected by a transversely extending front wall 43, opposite ends of which overlap the inside surfaces of the front wall sections 15 and 16 of the frame 10. Integral with and projecting rearwardly from the lower edge of the front wall 43 of member 40 with the underside thereof in coplanar engagement with the upper surface of the cap 30, is a plane bottom wall section 44, a portion of which adjacent the end thereof remote from wall 43 is bent diagonally upwardly as at 45 in FIG. 4. As shown more clearly in FIG. 4, the ends of the sidewalls 41 and 42 remote from the front wall section 43 are not interconnected, but are disposed in confronting relation to the inside surface of the frame wall 12.

Figure 2:
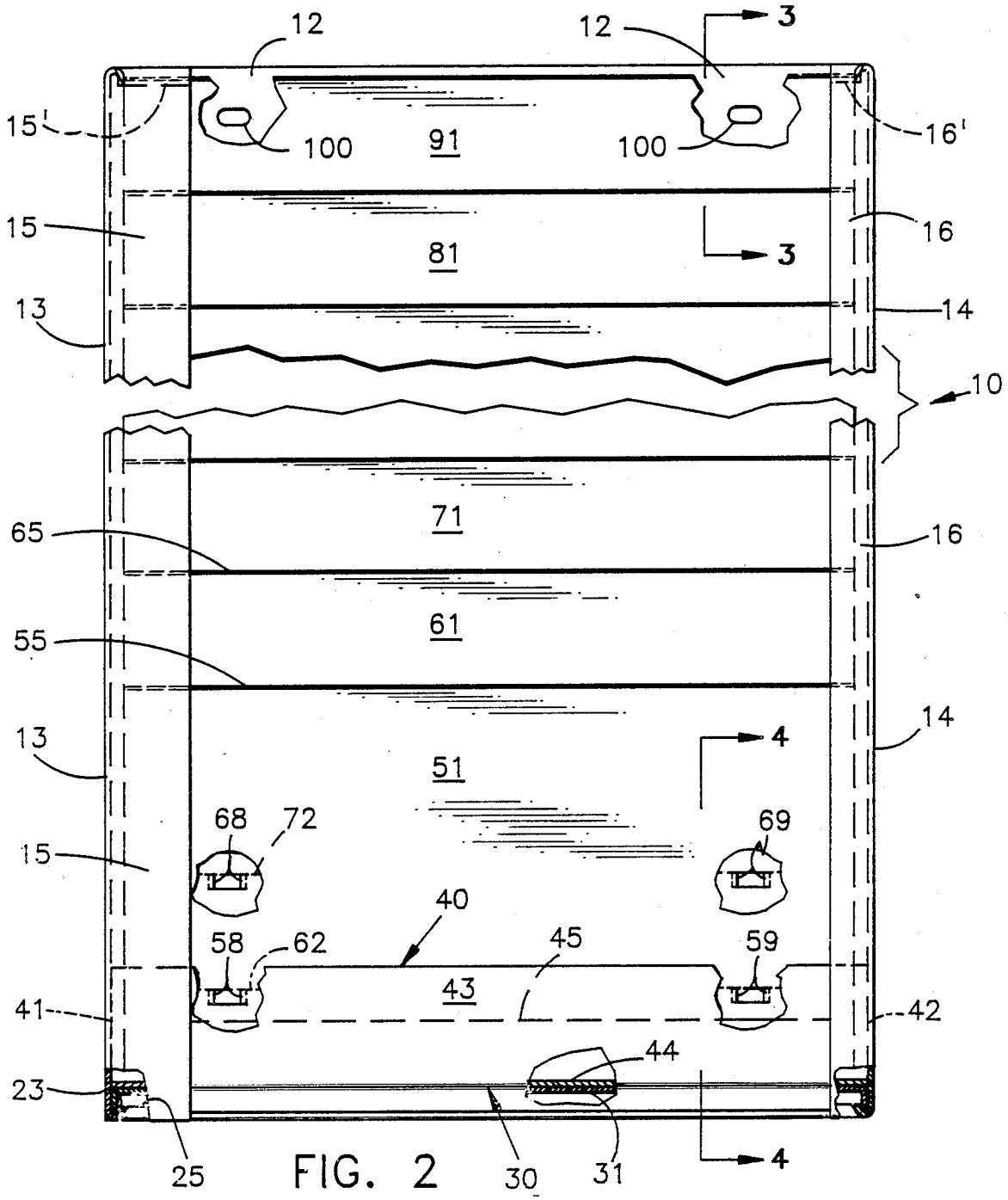
FIG. 2 is a fragmentary front elevational view of this device with portions thereof broken away for purposes of illustration.

Removably mounted in the frame 10 to extend transversely between the side walls 13 and 14 thereof, and to lie in parallel planes inclined to the vertical, or to the rear wall 12 of the frame, is a plurality of plane, sheet metal document dividers or partitions, the lowermost of which is denoted in FIGS. 2 and 4 by the numeral 51. The lowermost partition, which may also be referred to as the starter leaf or partition, has a first marginal portion thereof adjacent its lower edge bent at an acute angle to form thereon a vertical section 52, and a second, terminal portion thereof bent to form a terminal lip or flange 53 along the lower edge of the partition. When partition 51 is properly seated in the frame 10, its lip 53 on the lower end thereof passes beneath the inclined section 45 of the bottom wall 44 of member 40 (FIG. 4), while the vertical section 52 has substantially coplanar engagement with the inside surface of the rear wall 12 of the frame 10. The remaining portion of partition 51 passes upwardly over the outer edge of the section 45 of member 40, and extends diagonally forwardly toward the front of frame 10, where its upper edge 55 (FIG. 2) overlaps at opposite ends thereof the inside surfaces of the front wall sections 15 and 16 of frame 10.

To help support the next partition in the frame above partition 51, partition 51 has struck therefrom, in the embodiment illustrated, two spaced pairs of tabs 58 and 59. As shown more clearly in FIG. 4, these tabs project from the rear or upper surface of partition 51 at points equispaced upwardly from its section 52, and adjacent opposite sides of the partition 51.

Removably mounted in the frame 10 above and in spaced, parallel relation to the partition 51 is the next partition or divider 61, which adjacent its lower end is bent at a right angle to form along the lower edge thereof a rearwardly projecting lip or flange 62, which has a marginal edge or portion which extends behind and is supported by the tabs 58 and 59 which project from divider 51. As in the case of divider 51, the upper edge 65 (FIG. 2) of the divider 61 is engaged adjacent opposite ends thereof with inside surfaces of the frame sections 15 and 16 along a line spaced above and parallel to the line of engagement of the upper edge 55 of the divider 51 with these frame sections.

As in the case of the divider 51, and as shown more clearly in FIG. 2, divider 61 also has struck therefrom at points equispaced above its flange 62 two pairs of spaced tangs 68 and 69, which are adapted to function in the manner of tangs 58 and 59, for supporting thereon the flange 72 (FIG. 2) which projects rearwardly from the next divider 71 that is mounted in frame 10 above, and in a manner similar to, divider 61.

In FIGS. 1 to 3 numeral 91 denotes the uppermost of the dividers that are mounted in frame 10, and 81 denotes the divider positioned next beneath divider 91. Each of these dividers, as in the case of dividers 51 and 61, will have formed thereon adjacent its lower end a rearwardly projecting flange section (not illustrated), which will engage the two pairs of tangs that are struck from the divider positioned therebeneath. The uppermost divider 91, therefore, is mounted in the frame in a manner similar to that of the other dividers, except that its upper edge 95 (FIG. 3) is releasably seated, adjacent opposite ends thereof, beneath the rearwardly curving lips or edges 15' and 16', which are formed on the front wall sections 15 and 16 adjacent the upper edges thereof. Also, of course, it would not be necessary to provide partition 91 with tangs (such as tangs 59) since no further partition is to be mounted thereover.

As shown in FIG. 3, the upper edge 85 of the divider 81 is, as in the case of the dividers positioned therebeneath, merely seated against the inside surfaces of the frame sections 15 and 16. As noted above, however, the uppermost divider 91 will have its upper edge releasably secured beneath the rolled edges 15' and 16' to stabilize the device during use.

In use, documents may be inserted in the spaces between adjacent dividers, such as for example the diagonal space between the dividers 51 and 61. In such case the lower edges of the documents will become seated on the right angular flange 62, which forms the bottom of the document holding space formed between dividers 51 and 61. The advantage of this construction is that the width of the space between dividers 51 and 61 remains substantially constant from the point where the space opens on the front of the frame 10 between the spaced wall sections 15 and 16, to the closed end of the space as defined by the flange 62 at the bottom thereof. With the exception of the space located above the uppermost divider 91, this is true for all of the document spaces formed between adjacent dividers, and prevents any undesirable cramming of the stored documents at the bottom of a respective storage space.

Moreover, a rather large storage compartment is created beneath the lowermost divider 51 and the enclosure formed by the side, front and bottom walls of member 40. Access to this compartment is provided through the opening formed by the bottom of divider 51 and the space between the frame sections 15 and 16. This compartment can function as a storage space for items other than documents, if desired. Also, the length of the vertical section 52 on the starter leaf or partition can be varied as may be needed in order to maintain standard outside dimensions for the other partitions in a unit, despite variations in the heights of units.

From the foregoing it will be apparent that the present invention provides a relatively simple and inexpensive means for producing an extremely reliable and sturdy, weldment-free document storage device. The frame 10 forms a plane bottom surface which can be used for supporting the device on a flat surface; or alternatively, spaced slots or apertures 100 (FIG. 2) can be formed in the frame wall 12 adjacent its upper edge for use in supporting the device by means of screws, hooks, or the like on a vertical wall surface. In any case, the principal advantage is that the entire device can be made simply by properly stamping and shaping sheet metal panels, and then assembling the sheet metal elements as described above. No special fastening means are required, because the several parts interlock one with the other also to permit removal and replacement of the parts if necessary.

It will be appreciated that, while it is preferred to manufacture the device from sheet metal, equivalent such materials may be employed if desired. Also, if sheet metal is employed, it is obvious that the sheet metal can be coated or laminated with protective write-on, write-off surfaces, or the like. As a matter of fact, this is one of the primary advantages over prior, welded-type document holders which had to be painted or coated after being welded. With the present invention, on the other hand, prepainted or prefinished materials can be employed in manufacturing applicant's holders which in essence merely require stacking and latching prefinished parts, thereby eliminating the need for any painting or coating thereof after assembly.

Furthermore, it will be apparent that the number and shape of the tabs or detents (e.g., 58,59) on a partition may be varied, and the upper edges of the partitions may be rolled without departing from this invention. Moreover, although this invention has been illustrated and described in connection with only certain embodiments thereof, it will be apparent that it is capable of still further modification, and that this application is intended to cover any such modifications as may fall within the scope of one skilled in the art or the appended claims.

We claim:

1. A document holder, comprising a housing having a plane back wall, and spaced, parallel side walls projecting substantially equi-distantly forwardly from said back wall and defining therebetween a large opening in the front of the housing, a horizontal bottom plate removably secured adjacent its marginal edges to the lower edges of said back wall and side walls, and operatively closing the lower end of said housing, a plurality of spaced, parallel, planar partitions having upper and lower edges, respectively, means supporting said partitions slidably and removably one above the other in said housing to extend between said upper and lower edges thereof in parallel planes disposed substantially at right angles to said side walls and diagonally of said back wall, said partitions defining therebetween in said housing a plurality of document holding spaces inclined to the vertical, and opening at their upper ends on said large opening in the front of said housing, and means for closing the lower end of each of said document holding spaces, said closing means defining at the bottom of each of said document holding spaces a plane surface extending transversely between the two partitions defining such space, and said parition supporting means including means releasably securing only the uppermost of said partitions to said housing, whereby upon release and removal of said uppermost partition from said housing, the remaining partitions are free to be withdrawn slidably from said housing.

2. A document holder as defined in claim 1, wherein said closing means comprises a flange formed on one of said partitions and projecting at right angles toward and into releasable engagement with an adjacent one of said partitions.

3. A document holder as defined in claim 2, wherein said flange is removably seated upon at least one projection on said adjacent one of said partitions.

4. A document holder as defined in claim 1, wherein said partition supporting means further comprises flanged sections formed on said side walls of said housing and disposed releasably to engage and support the upper edges of said partitions in spaced relation to each other, and said securing means comprises marginal portions of said flanged sections adjacent the upper edge thereof releasably overlying the upper edge of the uppermost of said partitions normally to prevent withdrawal of said uppermost partition from said housing.

5. A document holder as defined in claim 1, including means defining a removable compartment in said housing above said bottom plate and beneath the lowermost of said partitions, said compartment having an open upper end confronting upon the underside of said lowermost partition, and communicating with said large opening in the front of said housing.

6. A document holder as defined in claim 1, wherein said side walls have formed thereon adjacent their forward edges inwardly projecting lateral flanges, which are disposed in spaced, confronting relation to each other at opposite sides of said opening in the front of said housing, and each of said partitions has portions of its upper edge adjacent opposite ends thereof seated against said lateral flanges.

7. A document holder as defined in claim 6, wherein said securing means comprises portions of the upper edges of said lateral flanges formed to overlie portions of the upper edge of the uppermost partition in said housing thereby releasably securing said uppermost partition against removal from said housing.

8. A document holder, comprising a sheet metal housing having a plane back wall, and spaced, parallel side walls projecting substantially equi-distantly forwardly from said back wall and defining therebetween a large opening in the front of the housing, means removably secured to the lower edges of said side walls, and operatively fixing said lower edges thereof against movement toward and away from each other, a plurality of spaced, parallel, planar partitions removably supported in said housing in parallel planes extending substantially at right angles to said side walls and diagonally of said back wall, said partitions defining therebetween in said housing a plurality of document holding spaces inclined to the vertical, and opening at their upper ends on said large opening in the front of said housing, and flange means formed on the upper edges of said side walls and disposed releasably to overlie portions of the upper edge of only the uppermost partition in said housing, thereby releasably to secure said uppermost partition against removal from said housing, the upper edges of the remaining partitions in said plurality thereof being movable relative to said housing, said side walls of said housing being slightly flexible toward and away from each other adjacent their upper edges, thereby to permit selective engagement and disengagement of said flange means with said portions of the upper edge of said uppermost partition.

9. A document holder as defined in claim 8, wherein said means removably secured to the lower edges of said side walls comprises a rigid bottom plate operatively closing the lower end of said housing.

10. A document holder as defined in claim 9, wherein said bottom plate has thereon a downwardly projecting skirt flange releasably engaged with upwardly projecting flanges formed on the lower edges of said housing back wall and side walls.

11. A document holder as defined in claim 8, wherein each of said partitions is slidably supported in said housing between the side walls thereof and at least one of the two partitions of each pair thereof defining a document holding space in the holder has thereon a flange portion adjacent its inner end extending substantially at right angles between said pair of partitions and defining the bottom of said space.

12. A document holder as defined in claim 11, including a container removably mounted in said housing beneath the lowermost partition and having an open upper end facing the underside of said lowermost partition and communicating with said opening in the front of said housing.

* * * * *